US008974647B2

(12) United States Patent
Shodai et al.

(10) Patent No.: US 8,974,647 B2
(45) Date of Patent: Mar. 10, 2015

(54) GAS GENERATION DEVICE

(75) Inventors: Yoshio Shodai, Osaka (JP); Masashi Kodama, Kanagawa (JP); Nobutaka Manabe, Osaka (JP); Noriyuki Tanaka, Osaka (JP)

(73) Assignee: Toyo Tanso Co., Ltd., Osaka-shi (JP)

( * ) Notice: Subject to any disclaimer, the term of this patent is extended or adjusted under 35 U.S.C. 154(b) by 36 days.

(21) Appl. No.: 13/637,656

(22) PCT Filed: Mar. 18, 2011

(86) PCT No.: PCT/JP2011/001627

§ 371 (c)(1),
(2), (4) Date: Sep. 27, 2012

(87) PCT Pub. No.: WO2011/121929

PCT Pub. Date: Oct. 6, 2011

(65) Prior Publication Data

US 2013/0008783 A1 Jan. 10, 2013

(30) Foreign Application Priority Data

Mar. 29, 2010 (JP) ..... 2010-075088

(51) Int. Cl.
*C25B 15/08* (2006.01)
*C25B 1/24* (2006.01)
*C25B 9/00* (2006.01)

(52) U.S. Cl.
CPC . *C25B 1/245* (2013.01); *C25B 9/00* (2013.01); *C25B 15/08* (2013.01)
USPC ..... 204/278; 204/247; 204/242; 205/411

(58) Field of Classification Search
CPC ..... C25B 1/245; C25B 15/08
USPC ..... 204/242, 278, 247; 205/411
See application file for complete search history.

(56) References Cited

U.S. PATENT DOCUMENTS

2003/0121796 A1* 7/2003 Siegele et al. ..... 205/556
2004/0007457 A1 1/2004 Tojo et al.
2004/0037768 A1* 2/2004 Jackson ..... 423/500
2004/0055874 A1* 3/2004 Hiraiwa et al. ..... 204/250

(Continued)

FOREIGN PATENT DOCUMENTS

CN 1478924 A 3/2004
CN 1807555 A 7/2006

(Continued)

OTHER PUBLICATIONS

English Translation of JP 2003-190762 to Ino et al.; 2003.*

(Continued)

*Primary Examiner* — Zulmariam Mendez
(74) *Attorney, Agent, or Firm* — Oblon, McClelland, Maier & Neustadt, L.L.P.

(57) ABSTRACT

The fluorine gas generation device includes an electrolyzer. An electrolytic bath is formed in the electrolyzer. A cathode is disposed in a cathode chamber, and an anode is disposed in an anode chamber. As a voltage is applied across the cathode and the anode, electrolysis of HF (hydrogen fluoride) takes place. In the electrolyzer, hydrogen gas is primarily generated from the cathode and fluorine gas is primarily generated from the anode. Two heating furnaces are provided for heating NaF pellets packed in HF adsorption columns. Each heating furnace has two HF adsorption columns disposed therein.

5 Claims, 6 Drawing Sheets

(56) References Cited

U.S. PATENT DOCUMENTS

| | | | | |
|---|---|---|---|---|
| 2004/0108201 | A1 | 6/2004 | Tojo et al. | |
| 2012/0031752 | A1 * | 2/2012 | Mori et al. | 204/247 |

FOREIGN PATENT DOCUMENTS

| | | | |
|---|---|---|---|
| JP | 57 50544 | | 3/1982 |
| JP | 2003-190762 | A | 7/2003 |
| JP | 2004 52105 | | 2/2004 |
| JP | 2004 169123 | | 6/2004 |
| JP | 2005 103520 | | 4/2005 |
| JP | 2006 198604 | | 8/2006 |
| JP | 2008 308536 | | 12/2008 |

OTHER PUBLICATIONS

Office Action issued Sep. 3, 2013 in Japanese Patent Application No. 2010-075088 with English language translation.

International Search Report Issued Apr. 26, 2011 in PCT/JP11/001627 Filed Mar. 18, 2011.

Combined Chinese Office Action and Search Report issued Aug. 21, 2014 in Patent Application No. 201180016695.7 with English language translation and English Translation of Category of Cited Documents.

* cited by examiner

GAS GENERATION DEVICE

TECHNICAL FIELD

The present invention relates to a gas generation device that generates a gas.

BACKGROUND ART

Conventionally, fluorine gas is used in the semiconductor manufacturing process and so on for material cleaning, surface modification, and other purposes. While the fluorine gas itself is used in some cases, a variety of fluorine-based gases synthesized based on the fluorine gas, such as $NF_3$ (nitrogen trifluoride) gas, NeF (neon fluoride) gas, and ArF (argon fluoride) gas, may also be used in other cases.

For supplying fluorine gas stably in such sites, a fluorine gas generation device that generates fluorine gas by electrolysis of HF (hydrogen fluoride), for example, is used.

The fluorine gas generation device disclosed in Patent Document 1 includes an electrolyzer. The interior of the electrolyzer is divided by a partition wall into a cathode chamber and an anode chamber. In the electrolyzer, an electrolytic bath is formed with a KF-HF-based mixed molten salt. A cathode is disposed in the cathode chamber, and an anode is disposed in the anode chamber. HF is supplied through an HF supply line to the electrolytic bath in the electrolyzer for electrolysis of HF, whereby hydrogen gas is generated from the cathode and fluorine gas is generated from the anode in the electrolyzer.

At the top of the cathode chamber, an outlet for hydrogen gas is provided. The hydrogen gas generated in the cathode chamber exits from the outlet and is discharged through a hydrogen gas line on the cathode side. The hydrogen gas line is provided with an automatic valve and an HF adsorption column. The HF adsorption column is packed with granular NaF (sodium fluoride) pellets. This enables HF mixed in the hydrogen gas to be adsorbed by the NaF pellets in the HF adsorption column and, thus, removed from the hydrogen gas.

At the top of the anode chamber, an outlet for fluorine gas is provided. The fluorine gas generated in the anode chamber exits from the outlet and is discharged through a fluorine gas line. The fluorine gas line is provided with an HF adsorption column and an automatic valve. As in the hydrogen gas line, HF mixed in the fluorine gas is adsorbed by the NaF pellets in the HF adsorption column and, thus, removed from the fluorine gas.

On the fluorine gas line, a compressor unit is provided on the downstream of the HF adsorption column and the automatic valve.

In each of the cathode chamber and anode chamber, a pressure gauge for measuring the pressure in the corresponding chamber is provided. The automatic valves disposed on the hydrogen gas line and fluorine gas line open/close in accordance with the pressure values measured by the pressure gauges.

The automatic valve on the fluorine gas line opens when the pressure inside the anode chamber is higher than atmospheric pressure, causing the fluorine gas in the anode chamber to be sucked through the fluorine gas line into the compressor unit. On the other hand, the automatic valve on the fluorine gas line closes when the pressure inside the anode chamber is lower than atmospheric pressure.

[Patent Document 1] JP 2004-52105 A

SUMMARY OF INVENTION

Technical Problem

When NaF pellets adsorb HF excessively, the NaF pellets decompose into powder, which in turn agglutinates. In this case, the interior of HF adsorption columns or piping connected to the HF adsorption columns may be clogged with the agglutinated NaF. This raises the need to replace the NaF pellets in the HF adsorption columns at regular intervals, which requires troublesome work as well as cost.

An object of the present invention is to provide a gas generation device capable of reducing work burden and cost.

Solution to Problem (1) According to an aspect of the present invention, a gas generation device that generates a first gas and a second gas by electrolysis includes an electrolyzer divided into a first chamber and a second chamber and containing therein an electrolytic bath including a compound to be electrolyzed, a first discharge path through which the first gas generated in the first chamber is discharged, a second discharge path through which the second gas generated in the second chamber is discharged, first and second adsorbers that each include an adsorbent for adsorbing a third gas mixed in the first gas, third and fourth adsorbers that each include an adsorbent for adsorbing the third gas mixed in the second gas, a connector configured to be switchable between a first state and a second state, the first state being the state where the first and third adsorbers are connected to the first and second discharge paths, respectively, and the second and fourth adsorbers are disconnected from the first and second discharge paths, respectively, the second state being the state where the second and fourth adsorbers are connected to the first and second discharge paths, respectively, and the first and third adsorbers are disconnected from the first and second discharge paths, respectively, a first heater that heats the adsorbents in the first and third adsorbers, a second heater that heats the adsorbents in the second and fourth adsorbers, and a controller that controls the connector, the first heater, and the second heater, wherein the controller switches the connector between the first state and the second state, and when the connector is in the first state, the controller controls the first and second heaters such that the third gas is adsorbed by the adsorbents in the first and third adsorbers and the third gas is desorbed from the adsorbents in the second and fourth adsorbers, and when the connector is in the second state, the controller controls the first and second heaters such that the third gas is adsorbed by the adsorbents in the second and fourth adsorbers and the third gas is desorbed from the adsorbents in the first and third adsorbers.

In this gas generation device, electrolysis of the compound included in the electrolytic bath takes place, so that the first gas is generated in the first chamber and the second gas is generated in the second chamber. The first gas generated in the first chamber is discharged through the first discharge path, while the second gas generated in the second chamber is discharged through the second discharge path.

In the case where the connector is in the first state, the first and third adsorbers are connected to the first and second discharge paths, respectively, and the second and fourth adsorbers are disconnected from the first and second discharge paths, respectively. As a result, the first gas generated in the first chamber is guided to the first adsorber, while the second gas generated in the second chamber is guided to the third adsorber.

In this case, the adsorbents in the first through fourth adsorbers are heated by the first and second heaters such that the third gas is adsorbed by the adsorbents in the first and third adsorbers and that the third gas is desorbed from the adsorbents in the second and fourth adsorbers.

In the case where the connector is in the second state, the second and fourth adsorbers are connected to the first and second discharge paths, respectively, and the first and third adsorbers are disconnected from the first and second discharge paths, respectively. As a result, the first gas generated in the first chamber is guided to the second adsorber, while the second gas generated in the second chamber is guided to the fourth adsorber.

In this case, the adsorbents in the first through fourth adsorbers are heated by the first and second heaters such that the third gas is adsorbed by the adsorbents in the second and fourth adsorbers and that the third gas is desorbed from the adsorbents in the first and third adsorbers.

As a result, when the connector is in the second state, the third gas adsorbed to the adsorbents in the first and third adsorbers is desorbed from the adsorbents. On the other hand, when the connector is in the first state, the third gas that was adsorbed by the adsorbents in the second and fourth adsorbers while the connector was in the second state is desorbed from the adsorbents.

Therefore, by switching the connector alternately between the first and second states, it is possible to prevent the third gas from being excessively adsorbed to the adsorbents in the first through fourth adsorbers, without the need to replace the adsorbents in the first through fourth adsorbers. As a result, the work burden as well as cost can be reduced.

Further, in both cases where the connector is in the first state and in the second state, the first and second gases of high purity, with the third gas removed therefrom, are discharged through the first and second discharge paths. This allows the first and second gases to be supplied continuously, while preventing the third gas from being excessively adsorbed to the adsorbents in the first through fourth adsorbers.

(2) The gas generation device may further include a first circulation path through which the third gas desorbed from the adsorbent in the second adsorber is guided to the first chamber when the connector is in the first state, and through which the third gas desorbed from the adsorbent in the first adsorber is guided to the first chamber when the connector is in the second state, and a second circulation path through which the third gas desorbed from the adsorbent in the fourth adsorber is guided to the second chamber when the connector is in the first state, and through which the third gas desorbed from the adsorbent in the third adsorber is guided to the second chamber when the connector is in the second state.

In this case, the third gas desorbed from the adsorbents in the first and second adsorbers is guided to the first chamber, while the third gas desorbed from the adsorbents in the third and fourth adsorbers is guided to the second chamber. This enables the third gas desorbed from the adsorbents to be used again as the material for electrolysis. As a result, the cost can further be reduced.

(3) The gas generation device may further include a first gas supplier that supplies a fourth gas to the second adsorber when the connector is in the first state, and that supplies the fourth gas to the first adsorber when the connector is in the second state, and a second gas supplier that supplies a fifth gas to the fourth adsorber when the connector is in the first state, and that supplies the fifth gas to the third adsorber when the connector is in the second state.

In this case, when the connector is in the first state, the fourth and fifth gases are supplied from the first and second gas suppliers to the second and fourth adsorbers, so that the third gas desorbed from the adsorbents in the second and fourth adsorbers is pushed out of the second and fourth adsorbers. Further, when the connector is in the second state, the fourth and fifth gases are supplied from the first and second gas suppliers to the first and third adsorbers, so that the third gas desorbed from the adsorbents in the first and third adsorbers is pushed out of the first and third adsorbers. This prevents the third gas desorbed from the adsorbents from being re-adsorbed in the first through fourth adsorbers.

(4) The first gas supplier may include a storage that stores part of the first gas discharged through the first discharge path, and a gas supply path through which the first gas stored in the storage is guided as the fourth gas to the second adsorber when the connector is in the first state, and through which the first gas stored in the storage is guided as the fourth gas to the first adsorber when the connector is in the second state.

In this case, part of the first gas generated in the first chamber is supplied to the first and second adsorbers, so that the third gas desorbed from the adsorbents in the first and second adsorbers is pushed out of the first and second adsorbers without the use of another gas. This can prevent the third gas from being re-adsorbed by the adsorbents in the first and second adsorbers without an increase in cost.

(5) Of the first gas discharged through the first discharge path, an excess over a required amount may be stored in the storage. In this case, the excess of the first gas is used to push the third gas out of the first and second adsorbers. This can prevent the third gas from being re-adsorbed by the adsorbents in the first and second adsorbers, while securing the required amount of first gas.

(6) The first gas may be fluorine gas, the second gas may be hydrogen, the third gas and the compound may be hydrogen fluoride, the adsorbents may be sodium fluoride, the first chamber may be an anode chamber, and the second chamber may be a cathode chamber.

In this case, hydrogen fluoride that is mixed in the fluorine gas and hydrogen generated by electrolysis of hydrogen fluoride can reliably be adsorbed by sodium fluoride. Further, hydrogen fluoride adsorbed to sodium fluoride can readily be desorbed from sodium fluoride.

Advantageous Effects of Invention

It is possible to prevent the third gas from being excessively adsorbed to the adsorbents in the first through fourth adsorbers, without the need of replacing the adsorbents in the first through fourth adsorbers. As a result, the work burden as well as cost can be reduced.

DESCRIPTION OF EMBODIMENTS

A gas generation device and a gas generation method according to an embodiment of the present invention will now be described with reference to the drawings. In the following embodiment, a fluorine gas generation device for generating fluorine gas will be described as an example of the gas generation device.

(1) Configuration of the Fluorine Gas Generation Device

Figure 1:
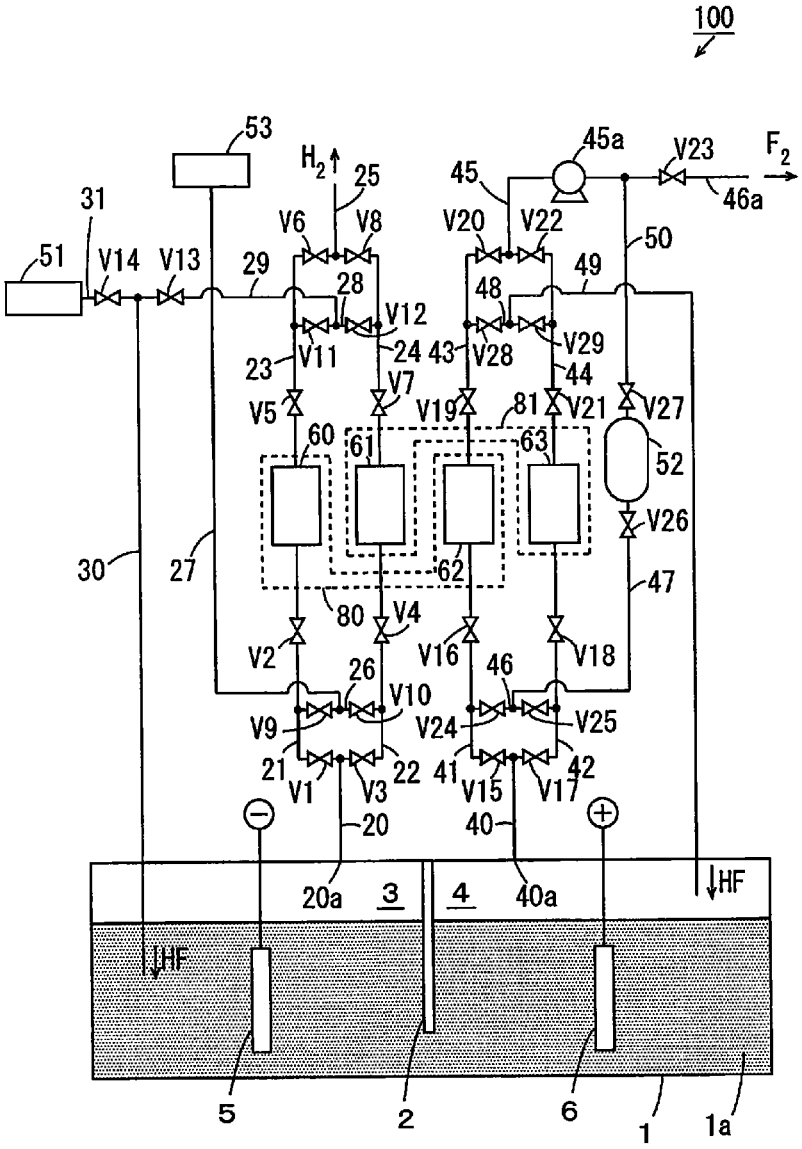
FIG. 1 is a schematic diagram showing the configuration of a fluorine gas generation device according to an embodiment of the present invention.

FIG. 1 is a schematic diagram showing the configuration of the fluorine gas generation device according to an embodiment of the present invention. As shown in FIG. 1, the fluorine gas generation device 100 includes an electrolyzer 1. The electrolyzer 1 is formed, for example, of Ni (nickel), Monel, pure iron, stainless steel, or other metal or alloy. The interior of the electrolyzer 1 is divided by a partition wall 2 into a cathode chamber 3 and an anode chamber 4. The partition wall 2 is made of Ni or Monel, for example.

In the electrolyzer 1, an electrolytic bath 1*a* of KF-HF-based mixed molten salt is formed. A cathode 5 of Ni (nickel), for example, is disposed in the cathode chamber 3, and an anode 6 of carbon with low polarizability, for example, is disposed in the anode chamber 4. When a voltage is applied across the cathode 5 and the anode 6, electrolysis of HF (hydrogen fluoride) takes place. As a result, in the electrolyzer 1, hydrogen gas is primarily generated from the cathode 5 and fluorine gas is primarily generated from the anode 6.

At the top of the cathode chamber 3, a cathode outlet 20*a* is provided. Connected to the cathode outlet 20*a* is an (upstream) end of a pipe 20. The other end of the pipe 20 is connected to an end of each of pipes 21, 22. The pipe 21 has open/close valves V1, V2 provided in this order from the upstream side. The pipe 22 has open/close valves V3, V4 provided in this order from the upstream side.

The pipe 21 has the other end connected to a gas inlet of an HF adsorption column 60. The pipe 22 has the other end connected to a gas inlet of an HF adsorption column 61. The interiors of the HF adsorption columns 60, 61 are packed with cylindrical NaF (sodium fluoride) pellets.

The HF adsorption column 60 has a gas outlet to which an end of a pipe 23 is connected. The pipe 23 has open/close valves V5, V6 provided in this order from the upstream side. The HF adsorption column 61 has a gas outlet to which an end of a pipe 24 is connected. The pipe 24 has open/close valves V7, V8 provided in this order from the upstream side.

The pipes 23 and 24 have their other ends connected to an end of a pipe 25. The other end of the pipe 25 is connected, for example, to a gas cylinder or a manufacturing line in a factory.

A portion of the pipe 21 located between the open/close valves V1, V2 and a portion of the pipe 22 located between the open/close valves V3, V4 are connected to each other via a pipe 26. The pipe 26 has open/close valves V9, V10 provided in this order from the pipe 21 side. A portion of the pipe 26 located between the open/close valves V9, V10 is connected to an end of a pipe 27. The pipe 27 has the other end connected to an inert gas tank 53. The inert gas tank 53 stores therein an inert gas, such as $N_2$ (nitrogen), Ar (argon), or He (Helium), at high pressure.

A portion of the pipe 23 located between the open/close valves V5, V6 and a portion of the pipe 24 located between the open/close valves V7, V8 are connected to each other via a pipe 28. The pipe 28 has open/close valves V11, V12 provided in this order from the pipe 23 side. A portion of the pipe 28 located between the open/close valves V11, V12 is connected to an end of a pipe 29. The pipe 29 is provided with an open/close valve V13. The pipe 29 has the other end connected to an end of each of pipes 30 and 31. The pipe 30 has the other end configured to be located in the electrolytic bath 1*a* in the cathode chamber 3.

The pipe 31 is provided with an open/close valve V14. The pipe 31 has the other end connected to an HF supply source 51. The liquid level of the electrolytic bath 1*a* is detected, for example, by a liquid level detector (not shown). When the detected liquid level is lower than a prescribed value, the open/close valve V13 is closed while the open/close valve V14 is opened. This causes HF to be supplied from the HF supply source 51 via the pipes 31, 30 into the electrolytic bath 1*a*.

At the top of the anode chamber 4, an anode outlet 40*a* is provided. Connected to the anode outlet 40*a* is an (upstream) end of a pipe 40. The pipe 40 has the other end connected to an end of each of pipes 41, 42. The pipe 41 has open/close valves V15, V16 provided in this order from the upstream side. The pipe 42 has open/close valves V17, V18 provided in this order from the upstream side.

The pipe 41 has the other end connected to a gas inlet of an HF adsorption column 62. The pipe 42 has the other end connected to a gas inlet of an HF adsorption column 63. The HF adsorption columns 62, 63 are packed with cylindrical NaF pellets.

The HF adsorption column 62 has a gas outlet to which an end of a pipe 43 is connected. The pipe 43 has open/close valves V19, V20 provided in this order from the upstream side. The HF adsorption column 63 has a gas outlet to which an end of a pipe 44 is connected. The pipe 44 has open/close valves V21, V22 provided in this order from the upstream side. The pipes 43 and 44 have their other ends connected to an end of a pipe 45. The pipe 45 is provided with a compressor 45*a*.

A portion of the pipe 41 located between the open/close valves V15, V16 and a portion of the pipe 42 located between the open/close valves V17, V18 are connected to each other via a pipe 46. The pipe 46 has open/close valves V24, V25 provided in this order from the pipe 41 side. A portion of the pipe 46 located between the open/close valves V24, V25 is connected to an end of a pipe 47. The pipe 47 is provided with an open/close valve V26. The pipe 47 has the other end connected to a buffer tank 52. In the buffer tank 52, fluorine gas generated in the anode chamber 4 is stored at high pressure, as will be described later. The buffer tank 52 is connected to an end of a pipe 50. The pipe 50 is provided with an open/close valve V27. The pipes 45 and 50 have their other ends connected to an end of a pipe 46*a*. The pipe 46 is provided with an open/close valve V23. The other end of the pipe 46*a* is connected, for example, to a gas cylinder or a manufacturing line in a factory.

A portion of the pipe 43 located between the open/close valves V19, V20 and a portion of the pipe 44 located between the open/close valves V21, V22 are connected to each other via a pipe 48. The pipe 48 has open/close valves V28, V29 provided in this order from the pipe 43 side. A portion of the pipe 48 located between the open/close valves V28, V29 is connected to an end of a pipe 49. The pipe 49 has the other end configured to be located in the upper space within the anode chamber 4.

In the fluorine gas generation device 100 according to the present embodiment, heating furnaces 80, 81 are provided for heating the NaF pellets packed in the HF adsorption columns 60-63. The HF adsorption columns 60, 62 are disposed in the heating furnace 80, while the HF adsorption columns 61, 63 are disposed in the heating furnace 81. The members constituting the heating furnaces 80, 81 are formed, for example, of stainless steel (SUS316L), nickel, Monel, copper, Inconel-based alloy, or Incoloy-based alloy.

(2) Operation

An operation of the fluorine gas generation device 100 will now be described. The fluorine gas generation device 100 operates alternately in a first operating state and a second operating state as described below.

Figure 2:
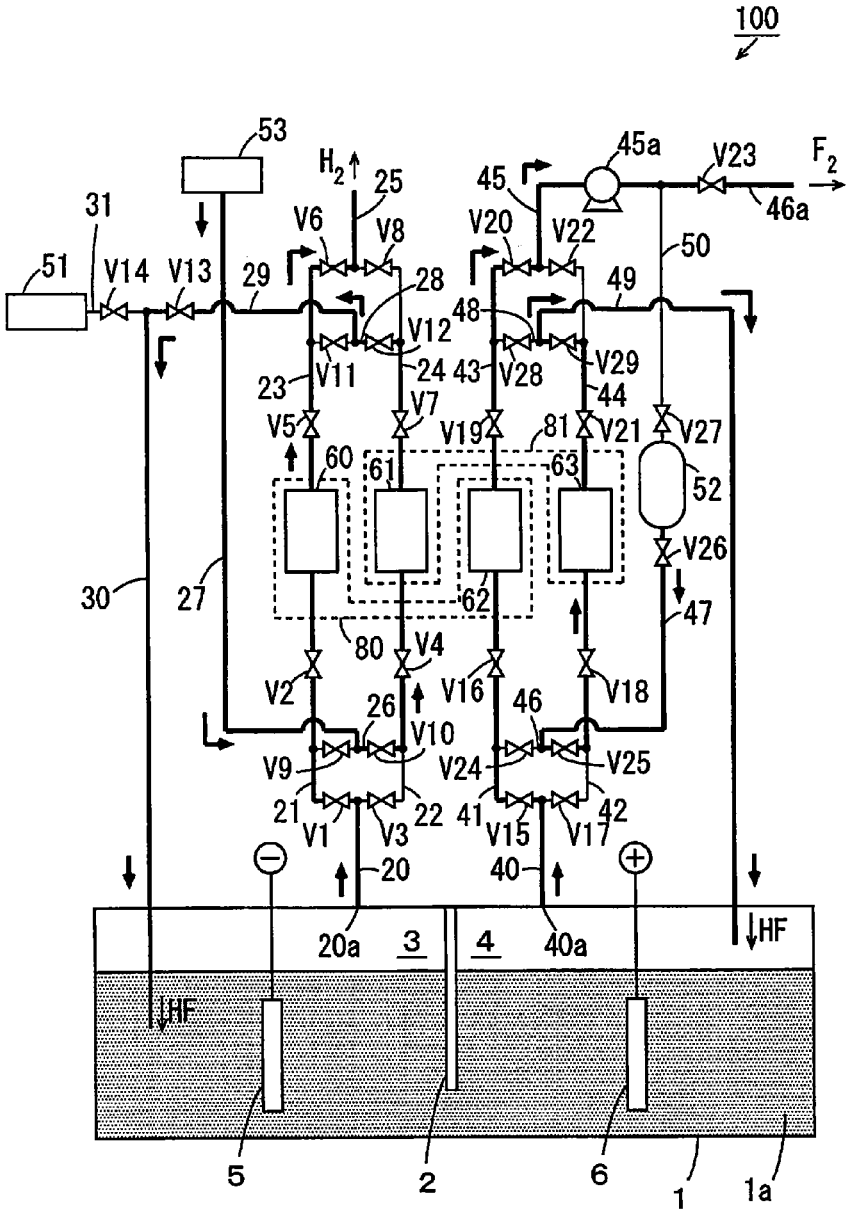
FIG. 2 is a diagram illustrating a first operating state.
Figure 3:
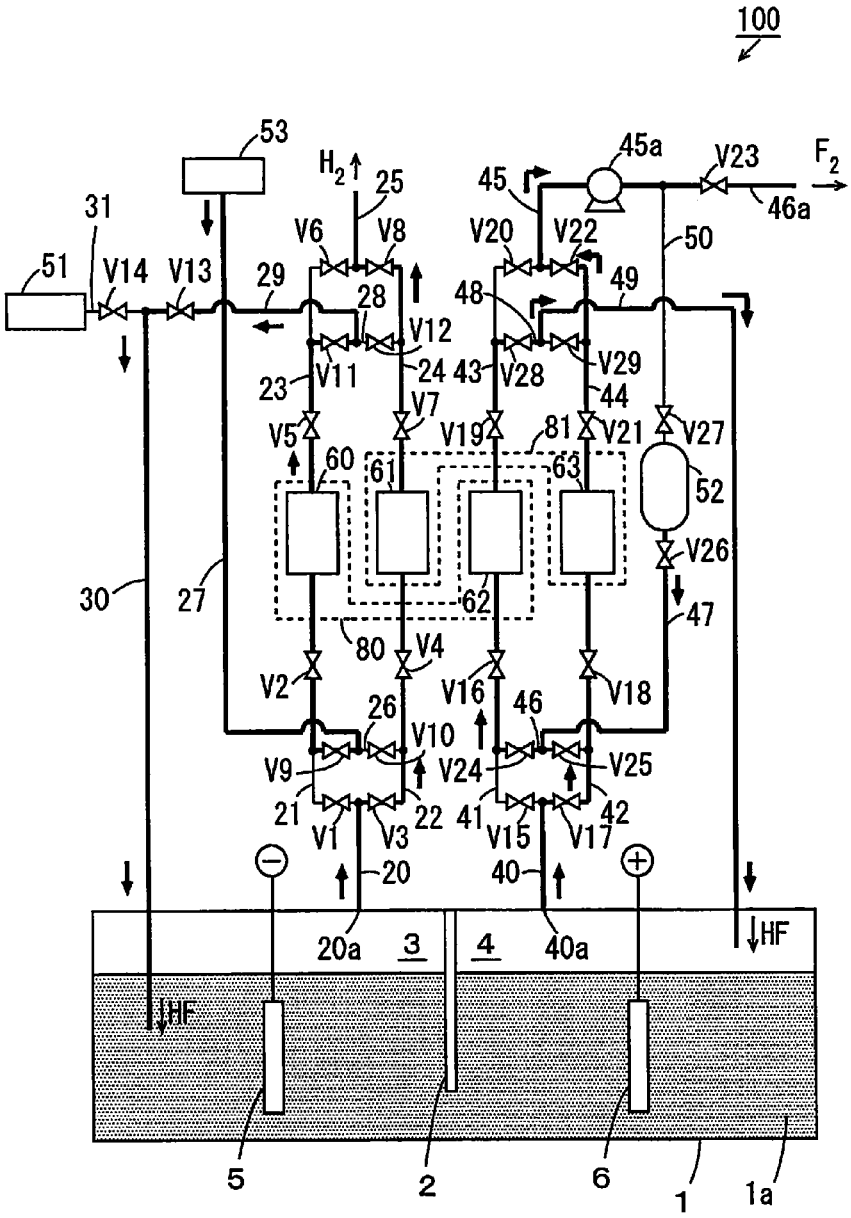
FIG. 3 is a diagram illustrating a second operating state.

FIG. 2 is a diagram illustrating the first operating state. FIG. 3 is a diagram illustrating the second operating state.

In the first operating state shown in FIG. 2, the open/close valves V1, V2, V4, V5, V6, V7, V10, V12, V13, V15, V16, V18, V19, V20, V21, V23, V25, V26, and V29 are opened, while the open/close valves V3, V8, V9, V11, V14, V17, V22, V24, V27, and V28 are closed. In this state, the compressor 45*a* is driven, and a voltage is applied across the cathode 5 and the anode 6 by a voltage applier 70 (see FIG. 4, which will be discussed later).

Further, the HF adsorption columns 60, 62 are heated at a first temperature by the heating furnace 80, while the HF adsorption columns 61, 63 are heated at a second temperature by the heating furnace 81. Here, the second temperature is higher than the first temperature. The first temperature may be 80° C. to 90° C., for example, and the second temperature may be 300° C., for example.

In this case, the hydrogen gas generated in the cathode chamber 3 is supplied through the pipes 20, 21, the HF adsorption column 60, and the pipes 23, 25, to a gas cylinder or a manufacturing line in a factory. In the HF adsorption column 60, HF mixed in the hydrogen gas is adsorbed by the NaF pellets and, thus, removed from the hydrogen gas.

Further, the fluorine gas generated in the anode chamber 4 is supplied through the pipes 40, 41, the HF adsorption column 62, and the pipes 43, 45, 46*a*, to a gas cylinder or a manufacturing line in a factory. In the HF adsorption column 62, HF mixed in the fluorine gas is adsorbed by the NaF pellets and, thus, removed from the fluorine gas.

Furthermore, the inert gas stored at high pressure in the inert gas tank 53 is fed through the pipes 27, 26, 22 to the HF adsorption column 61, while the fluorine gas stored at high pressure in the buffer tank 52 is fed through the pipes 47, 46, 42 to the HF adsorption column 63.

It is noted that in the first operating state and in the second operating state described later, the open/close valve V23 is temporarily closed and, at the same time, the open/close valve V27 is opened, so that the fluorine gas generated in the anode chamber 4 is guided to the buffer tank 52 for storage therein. In this case, of the fluorine gas generated in the anode chamber 4, an excess over the required amount (for example, the amount to be used in the manufacturing line in a factory) is stored in the buffer tank 52.

As the HF adsorption columns 61, 63 are heated at high temperature (second temperature), in the HF adsorption columns 61, 63, HF adsorbed to the NaF pellets is desorbed therefrom.

HF desorbed within the HF adsorption column 61 is pushed out of the HF adsorption column 61 by the inert gas fed from the inert gas tank 53, and is returned through the pipes 24, 28, 29, 30 into the electrolytic bath 1*a*. HF desorbed within the HF adsorption column 63 is pushed out of the HF adsorption column 63 by the fluorine gas fed from the buffer tank 52, and is returned through the pipes 44, 48, 49 to the upper space in the anode chamber 4.

It is noted that the heating of the HF adsorption columns 61, 63 by the heating furnace 81 is stopped after a lapse of certain time from the start of operation in the first operating state. Further, the open/close valves V4, V7, V10, V12, and V13 are closed, so that the supply of the inert gas from the inert gas tank 53 to the HF adsorption column 61 is stopped, and the open/close valves V18, V21, V25, V26, and V29 are closed, so that the supply of the fluorine gas from the buffer tank 52 to the HF adsorption column 63 is stopped. Hereinafter, the open/close valves V4, V7, V10, V12, V13, V18, V21, V25, V26, and V29 will be called a first valve group.

In the second operating state shown in FIG. 3, the open/close valves V2, V3, V4, V5, V7, V8, V9, V11, V13, V16, V17, V18, V19, V21, V22, V23, V24, V26, and V28 are opened, while the open/close valves V1, V6, V10, V12, V14, V15, V20, V25, V27, and V29 are closed. In this state, the compressor 45*a* is driven, and a voltage is applied across the cathode 5 and the anode 6 by the voltage applier 70 (see FIG. 4, which will be discussed later).

Further, the HF adsorption columns 61, 63 are heated at the first temperature by the heating furnace 81, while the HF adsorption columns 60, 62 are heated at the second temperature by the heating furnace 80.

In this case, the hydrogen gas generated in the cathode chamber 3 is supplied through the pipes 20, 22, the HF adsorption column 61, and the pipes 24, 25, to a gas cylinder or a manufacturing line in a factory. In the HF adsorption column 61, HF mixed in the hydrogen gas is adsorbed by the NaF pellets and, thus, removed from the hydrogen gas.

Further, the fluorine gas generated in the anode chamber 4 is supplied through the pipes 40, 42, the HF adsorption column 63, and the pipes 44, 45, 46*a*, to a gas cylinder or a manufacturing line in a factory. In the HF adsorption column 63, HF mixed in the fluorine gas is adsorbed by the NaF pellets and, thus, removed from the fluorine gas.

Furthermore, the inert gas stored at high pressure in the inert gas tank 53 is fed through the pipes 27, 26, 21 to the HF adsorption column 60, while the fluorine gas stored in the high pressure state in the buffer tank 52 is fed through the pipes 47, 46, 41 to the HF adsorption column 62.

As the HF adsorption columns 60, 62 are heated at high temperature (second temperature), in the HF adsorption columns 60, 62, HF adsorbed to the NaF pellets is desorbed therefrom.

HF desorbed within the HF adsorption column 60 is pushed out of the HF adsorption column 60 by the inert gas fed from the inert gas tank 53, and is returned through the pipes 23, 28, 29, 30 into the electrolytic bath 1*a*. HF desorbed within the HF adsorption column 62 is pushed out of the HF adsorption column 62 by the fluorine gas fed from the buffer tank 52, and is returned through the pipes 43, 48, 49 to the upper space in the anode chamber 4.

It is noted that the heating of the HF adsorption columns 60, 62 by the heating furnace 80 is stopped after a lapse of certain time from the start of operation in the second operating state. Further, the open/close valves V2, V5, V9, V11, and V13 are closed, so that the supply of the inert gas from the inert gas tank 53 to the HF adsorption column 60 is stopped, and the open/close valves V16, V19, V24, V26, and V28 are closed, so that the supply of the fluorine gas from the buffer tank 52 to the HF adsorption column 62 is stopped.

Hereinafter, the open/close valves V2, V5, V9, V11, V13, V16, V19, V24, V26, and V28 will be called a second valve group.

(3) Adsorption and Desorption of HF

As described above, in the first operating state, HF mixed in the hydrogen gas and the fluorine gas is adsorbed by the NaF pellets in the HF adsorption columns 60, 62 and, thus, removed from the hydrogen gas and the fluorine gas. Further, in the second operating state, HF mixed in the hydrogen gas and the fluorine gas is adsorbed by the NaF pellets in the HF adsorption columns 61, 63 and, thus, removed from the hydrogen gas and the fluorine gas.

As HF is removed from the fluorine gas and the hydrogen gas, hydrogen and fluorine gases of high purity can be supplied to manufacturing lines in a factory and so on. Further, the removal of highly corrosive HF can prevent corrosion of the pipes constituting the supply paths for the hydrogen gas and the fluorine gas.

If HF is excessively adsorbed to the NaF pellets in the HF adsorption columns 60-63, however, the NaF pellets will decompose into powder, which will then agglutinate. In such a case, the interiors of the HF adsorption columns 60-63 or the pipes 21-24, 41-44 connected to the HF adsorption columns 60-63 may be clogged with the agglutinated NaF.

In view of the foregoing, in the present embodiment, the HF adsorption columns 61, 63 are heated at the second temperature in the first operating state, so that HF is desorbed from the NaF pellets in the HF adsorption columns 61, 63. Further, the HF adsorption columns 60, 62 are heated at the second temperature in the second operating state, so that HF is desorbed from the NaF pellets in the HF adsorption columns 60, 62.

As the fluorine gas generation device 100 operates alternately in the first and second operating states, HF adsorbed by the NaF pellets in the HF adsorption columns 60, 62 in the first operating state is desorbed from the NaF pellets in the second operating state. Further, HF adsorbed by the NaF pellets in the HF adsorption columns 61, 63 in the second operating state is desorbed from the NaF pellets in the first operating state. This can prevent HF from being excessively adsorbed to the NaF pellets in the HF adsorption columns 60-63.

Here, in order to efficiently and reliably prevent excessive adsorption of HF to the NaF pellets, it is preferable to appropriately control the time for continuing the first operating state and the time for continuing the second operating state. Hereinafter, the time during which the first operating state is continued and the time during which the second operating state is continued will each be called the operation-continuing time T1.

Further, if the temperature and time for heating the NaF pellets for making HF desorbed therefrom are inappropriate, the NaF pellets may decompose into powder and the powder may agglutinate, as in the case where the NaF pellets adsorb HF excessively. It is thus preferable to appropriately control the second temperature, the heating time of the HF adsorption columns 61, 63 in the first operating state, and the heating time of the HF adsorption columns 60, 62 in the second operating state. Hereinafter, the time during which the HF adsorption columns 61, 63 are heated in the first operating state and the time during which the HF adsorption columns 60, 62 are heated in the second operating state will each be called the heating time T2.

The composition of the NaF pellet to which HF is adsorbed is expressed as: NaF•nHF (n>0). The present inventors have found, through experiments and investigation as will be described later, that the NaF pellet remains in a certain shape when the above "n" is within the range of not less than 0.01 and not more than 0.5. In the present embodiment, the operation-continuing time T1, the second temperature, and the heating time T2 are set in advance, through experiments and simulation, such that the NaF pellets in the HF adsorption columns 60-63 have the composition of: Na•nHF ($0.01 \leq n \leq 0.5$).

(4) Relation between the Adsorbed Amount of HF and the Shape of the NaF Pellet

In order to investigate the relation between the amount of HF adsorbed to the NaF pellet and the shape of the NaF pellet, the following experiment was carried out.

Fluorine gas having HF mixed therein was supplied to the HF adsorption columns 60-63 packed with a plurality of cylindrical NaF pellets. The total weight of the NaF pellets before supplying the fluorine gas was 15 kg, and the total weight of the NaF pellets after supplying the fluorine gas was 15.31 kg. This means that the amount of HF adsorbed to the NaF pellets was 0.31 kg.

After the supply of the fluorine gas, the NaF pellets were collected from a plurality of locations in the HF adsorption columns 60-63. In this case, in the HF adsorption columns 60-63, a greater amount of HF was adsorbed to the NaF pellet located at a more upstream side (at a location closer to the gas inlet). More specifically, the compositions of the collected NaF pellets were, from the upstream side, NaF•1.15HF, NaF•0.78HF, NaF•0.24HF, NaF•0.19HF, NaF•0.15HF, NaF•0.14HF, NaF•0.18HF, NaF•0.18HF, and NaF•0.22HF.

The NaF pellets with the compositions of NaF•1.15HF and NaF•0.78HF decomposed into powder and then agglutinated; they were unable to maintain the cylindrical form. In contrast, the NaF pellets with the compositions of NaF•0.24HF, NaF•0.19HF, NaF•0.15HF, NaF•0.14HF, NaF•0.18HF, and NaF•0.22HF experienced no decomposition into powder or agglutination; they remained in the cylindrical form.

From the above, it was found that the NaF pellet remains in the cylindrical form when the NaF pellet has the composition of: NaF•nHF ($0.01 \leq n \leq 0.5$).

(5) Control System in the Fluorine Gas Generation Device

Figure 4:
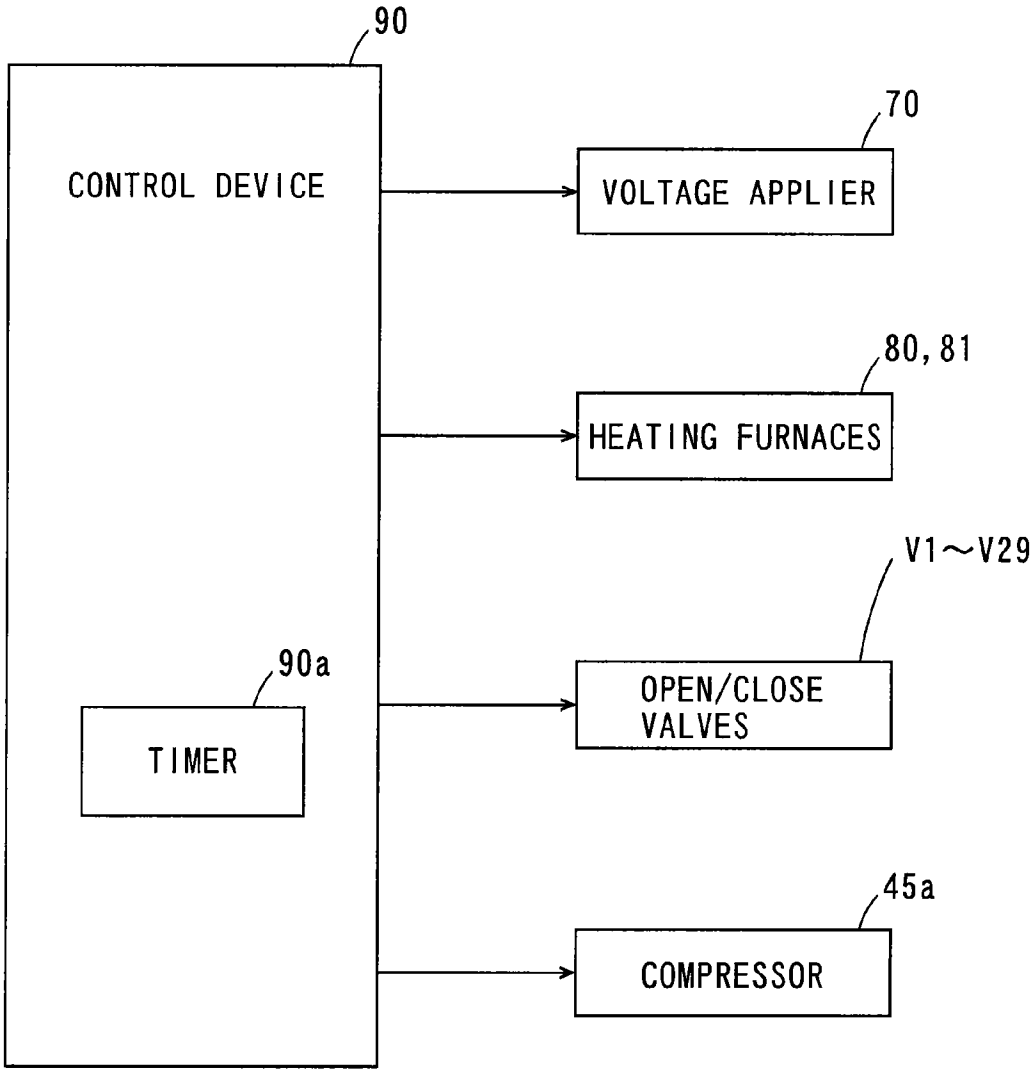
FIG. 4 is a block diagram showing a part of a control system in the fluorine gas generation device in FIG. 1.

FIG. 4 is a block diagram showing a control system in the fluorine gas generation device 100. The fluorine gas generation device 100 in FIG. 1 includes a control device 90 shown in FIG. 4. The control device 90 includes a central processing unit (CPU) and a memory, or a microcomputer. The control device 90 also has a timer 90*a*.

The control device 90 controls the operations of the voltage applier 70, the heating furnaces 80, 81, the open/close valves V1-V29, and the compressor 45*a*, to thereby control the timing for applying a voltage across the cathode 5 and the anode 6, the heating times and heating temperatures of the HF adsorption columns 60-63, the opening and closing of the open/close valves V1-V29, and the driving and stopping of the compressor 45*a*.

(6) Supply Path Switching Processing

Figure 5:
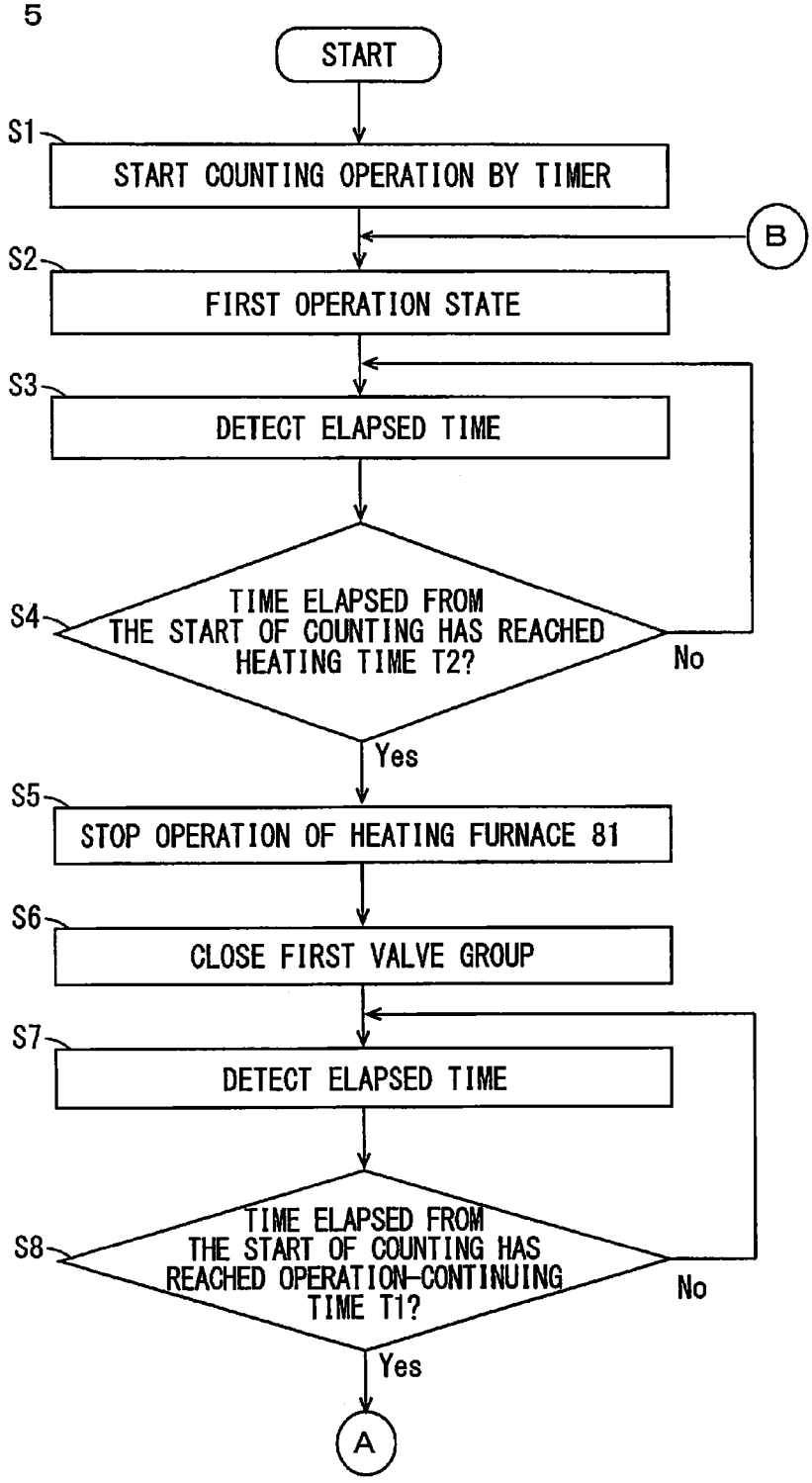
FIG. 5 is a flowchart illustrating, by way of example, processing for switching supply paths of fluorine gas and others performed by a control device in the fluorine gas generation device according to the present embodiment.
Figure 6:
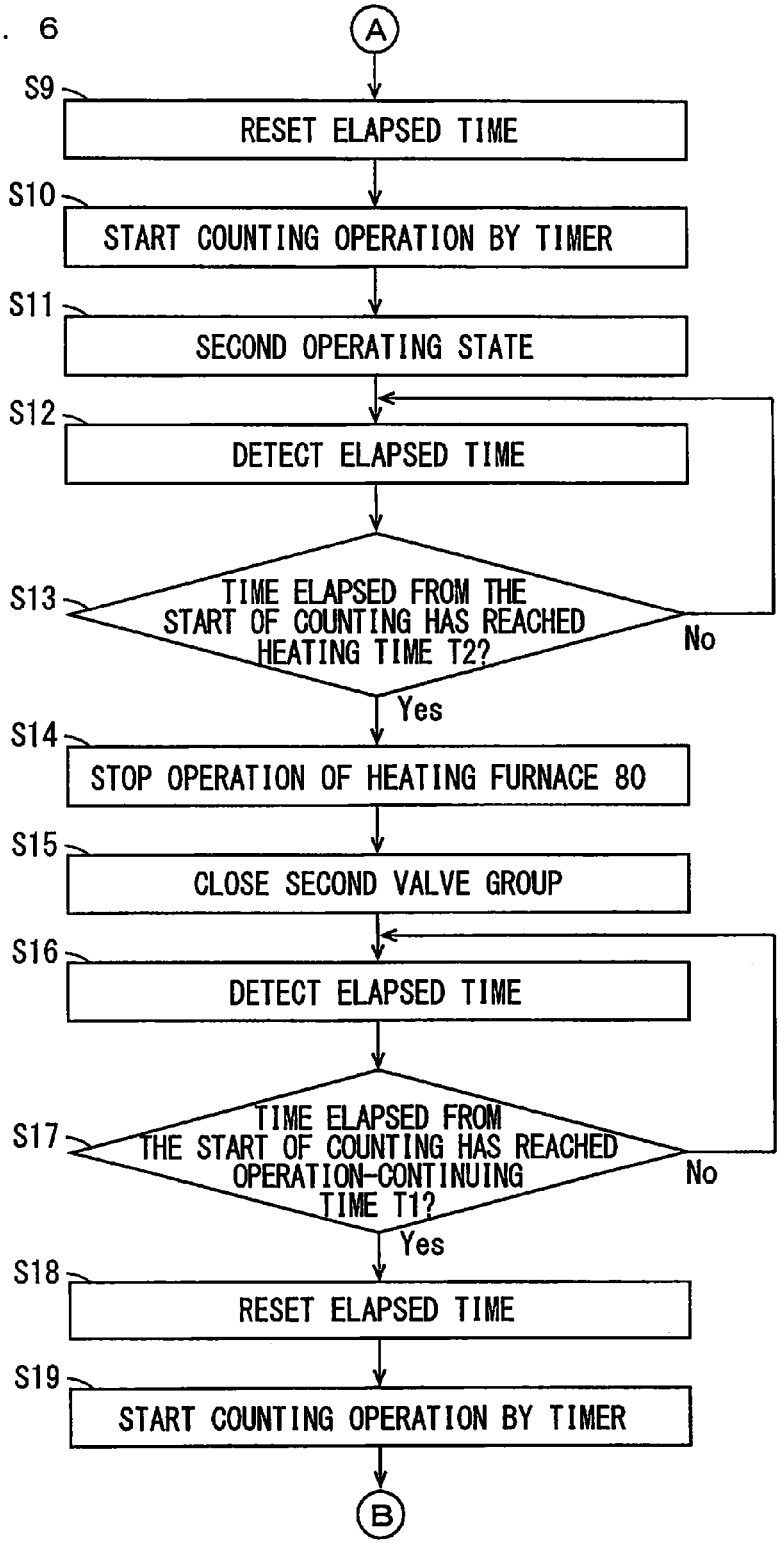
FIG. 6 is a flowchart illustrating, by way of example, the processing for switching the supply paths of fluorine gas and others performed by the control device in the fluorine gas generation device according to the present embodiment.

In the present embodiment, during the operation of the fluorine gas generation device 100, the control device 90 carries out the supply path switching processing as described below. FIGS. 5 and 6 show a flowchart illustrating, by way of example, the supply path switching processing by the control device 90. It is noted that the open/close valves V1-V29 are all closed in the initial state. Further, in this example, the fluorine gas generation device 100 initially operates in the first operating state.

First, when the start of electrolysis of HF is instructed by an input device (not shown) or the like, the control device 90 resets the elapsed time that was counted while the fluorine gas generation device 100 was previously operating, and starts the operation of counting the elapsed time by the built-in timer 90*a* (step S1).

Then, the control device 90 controls the voltage applier 70, the heating furnaces 80, 81, the open/close valves V1-V29, and the compressor 45*a* so as to cause the fluorine gas generation device 100 to operate in the first operating state shown in FIG. 2 (step S2).

More specifically, the control device 90 opens the open/close valves V1, V2, V4, V5, V6, V7, V10, V12, V13, V15, V16, V18, V19, V20, V21, V23, V25, V26, and V29, and closes the open/close valves V3, V8, V9, V11, V14, V17, V22, V24, V27, and V28. Further, the control device 90 drives the compressor 45*a*, and causes the voltage applier 70 to apply a voltage across the cathode 5 and the anode 6. Furthermore, the control device 90 causes the heating furnace 80 to heat the HF adsorption columns 60, 62 at the first temperature, and causes the heating furnace 81 to heat the HF adsorption columns 61, 63 at the second temperature.

Next, the control device 90 detects the elapsed time since when the counting was started in step S1 by the built-in timer 90*a* (step S3). Then, the control device 90 determines whether the detected elapsed time from the start of counting by the timer 90*a* has reached a preset heating time T2 (step S4).

If the elapsed time from the start of counting by the timer 90*a* has not reached the heating time T2, the control device 90 repeats the processing in steps S3, S4 until the elapsed time from the start of counting reaches the heating time T2.

If the elapsed time from the start of counting by the timer 90*a* has reached the heating time T2, the control device 90 stops the operation of the heating furnace 81 (step S5), and closes the first valve group described above (step S6). This causes the heating of the NaF pellets in the HF adsorption columns 61, 63 to be stopped, and also causes the supply of the inert gas and the fluorine gas to the HF adsorption columns 61, 63 to be stopped.

Next, the control device 90 detects the elapsed time since when the counting was started in step S1 by the built-in timer 90*a* (step S7). Then, the control device 90 determines whether the detected elapsed time from the start of counting by the timer 90*a* has reached a preset operation-continuing time T1 (step S8).

If the elapsed time from the start of counting by the timer 90*a* has not reached the operation-continuing time T1, the control device 90 repeats the processing in steps S7, S8 until the elapsed time from the start of counting reaches the operation-continuing time T1.

If the elapsed time from the start of counting by the timer 90*a* has reached the operation-continuing time T1, the control device 90 once resets the elapsed time counted by the timer 90*a* (step S9), and starts the operation of counting the elapsed time (step S10).

Then, the control device 90 controls the voltage applier 70, the heating furnaces 80, 81, the open/close valves V1-V29, and the compressor 45*a* so as to cause the fluorine gas generation device 100 to operate in the second operating state shown in FIG. 3 (step S11).

More specifically, the control device 90 opens the open/close valves V2, V3, V4, V5, V7, V8, V9, V11, V13, V16, V17, V18, V19, V21, V22, V23, V24, V26, and V28, and closes the open/close valves V1, V6, V10, V12, V14, V15, V20, V25, V27, and V29. Further, the control device 90 drives the compressor 45*a*, and causes the voltage applier 70 to apply a voltage across the cathode 5 and the anode 6. Furthermore, the control device 90 causes the heating furnace 81 to heat the HF adsorption columns 61, 63 at the first temperature, and causes the heating furnace 80 to heat the HF adsorption columns 60, 62 at the second temperature.

Next, the control device 90 detects the elapsed time since when the counting was started in step S10 by the built-in timer 90*a* (step S12). Then, the control device 90 determines whether the detected elapsed time from the start of counting by the timer 90*a* has reached a preset heating time T2 (step S13).

If the elapsed time from the start of counting by the timer 90*a* has not reached the heating time T2, the control device 90 repeats the processing in steps S12, S13 until the elapsed time from the start of counting reaches the heating time T2.

If the elapsed time from the start of counting by the timer 90*a* has reached the heating time T2, the control device 90 stops the operation of the heating furnace 80 (step S14), and closes the second valve group described above (step S15). This causes the heating of the NaF pellets in the HF adsorption columns 60, 62 to be stopped, and also causes the supply of the inert gas and the fluorine gas to the HF adsorption columns 60, 62 to be stopped.

Next, the control device 90 detects the elapsed time since when the counting was started in step S10 by the built-in timer 90*a* (step S16). Then, the control device 90 determines whether the detected elapsed time from the start of counting by the timer 90*a* has reached a preset operation-continuing time T1 (step S17).

If the elapsed time from the start of counting by the timer 90*a* has not reached the operation-continuing time T1, the control device 90 repeats the processing in steps S16, S17 until the elapsed time from the start of counting reaches the operation-continuing time T1.

If the elapsed time from the start of counting by the timer 90*a* has reached the operation-continuing time T1, the control device 90 once resets the elapsed time counted by the timer 90*a* (step S18), and starts the operation of counting the elapsed time (step S19). Thereafter, the control device 90 repeats the processing in steps S2 through S19.

(7) Effects

In the fluorine gas generation device 100 according to the present embodiment, HF that was adsorbed by the NaF pellets in the HF adsorption columns 60, 62 in the first operating state is desorbed from the NaF pellets in the second operating state. Further, HF that was adsorbed by the NaF pellets in the HF adsorption columns 61, 63 in the second operating state is desorbed from the NaF pellets in the first operating state. This can prevent HF from being excessively adsorbed to the NaF pellets in the HF adsorption columns 60-63, without the need of replacing the NaF pellets in the HF adsorption columns 60-63. As a result, work burden on the workers as well as cost can be reduced.

Further, in the fluorine gas generation device 100 according to the present embodiment, hydrogen and fluorine gases of high purity, with HF removed therefrom, can be supplied in both of the first and second operating states. This enables the hydrogen gas and the fluorine gas to be supplied continuously, while preventing HF from being excessively adsorbed to the NaF pellets in the HF adsorption columns 60-63.

Further, in the fluorine gas generation device 100 according to the present embodiment, HF desorbed from the NaF pellets in the HF adsorption columns 60-63 is returned into the electrolyzer 1. This enables HF desorbed from the NaF pellets to be used again as the material for electrolysis. As a result, the cost can further be reduced.

Further, in the fluorine gas generation device 100 according to the present embodiment, the operation-continuing time T1, the second temperature, and the heating time T2 are set such that the NaF pellets in the HF adsorption columns 60-63 have the composition of: $Na \cdot nHF$ ($0.01 \leq n \leq 0.5$). This reliably prevents the decomposition and agglutination of the NaF pellets, and reliably prevents the clogging of the interiors of the HF adsorption columns 60-63 as well as the clogging of the pipes 21-24, 41-44 connected to the HF adsorption columns 60-63.

Further, in the fluorine gas generation device 100 according to the present embodiment, the HF adsorption columns 60-63 can be used continuously, even if the HF adsorption columns 60-63 are small in size, without the need to replace the NaF pellets in the HF adsorption columns 60-63. This can further reduce the device cost and transport cost. It is noted that the HF adsorption columns 60-63 are made to have the volumetric capacities of 0.5 L to 2 L, for example.

(8) Other Embodiments

While the timing of switching between the first and second operating states is controlled on the basis of the time counted by the timer 90*a* in the above embodiment, not limited thereto, the timing of switching between the first and second operating states may be controlled in another way.

For example, the timing of switching between the first and second operating states may be controlled on the basis of the generated amounts of hydrogen gas and fluorine gas in the cathode chamber 3 and anode chamber 4. In this case, a sensor for detecting the generated amount of fluorine gas or hydrogen gas is provided in the electrolyzer 1, for example. Further, the amounts of generation of fluorine gas and hydrogen gas are set in advance such that the NaF pellets in the HF adsorption columns 60-63 have the composition of: NaF•nHF ($0.01 \leq n \leq 0.5$). At the time point when the generated amount of fluorine gas or hydrogen gas detected by the sensor has reached a preset value, the operating state is switched between the first and second operating states. In this manner, it is possible to efficiently and reliably prevent HF from being excessively adsorbed to the NaF pellets in the HF adsorption columns 60-63.

Further, while fluorine gas is generated in the anode chamber 4 and hydrogen gas is generated in the cathode chamber 3 in the above embodiment, oxygen or another gas may be generated in each of the anode chamber 4 and the cathode chamber 3.

Further, while fluorine gas stored in the buffer tank 52 is fed to the HF adsorption columns 62, 63 to cause HF desorbed from the adsorbents to be pushed out of the HF adsorption columns 62, 63 in the above embodiment, HF desorbed from the adsorbents may be pushed out of the HF adsorption columns 62, 63 in another way. For example, a gas tank storing an inert gas such as nitrogen, argon, or helium may be additionally provided, and the inert gas may be fed from the gas tank to the HF adsorption columns 62, 63, to thereby cause HF desorbed from the adsorbents to be pushed out of the HF adsorption columns 62, 63.

Further, while the switching between the first and second operating states, the stopping of the heating furnace 81 in the first operating state, and the stopping of the heating furnace 80 in the second operating state are performed automatically by the control device 90 in the above embodiment, an operator may perform the switching between the first and second operating states, stop the heating furnace 81 in the first operating state, and stop the heating furnace 80 in the second operating state.

(9) Correspondences between the Elements recited in the Claims and Those Described in the Embodiments In the following paragraphs, non-limiting examples of correspondences between various elements recited in the claims below and those described above with respect to various preferred embodiments of the present invention are explained.

In the embodiments described above, the fluorine gas generation device 100 is an example of the gas generation device, the anode chamber 4 is an example of the first chamber, the cathode chamber 3 is an example of the second chamber, fluorine gas is an example of the first gas, hydrogen gas is an example of the second gas, the pipe 40 is an example of the first discharge path, hydrogen fluoride is an example of the third gas, the pipe 20 is an example of the second discharge path, the HF adsorption column 62 is an example of the first adsorber, the HF adsorption column 63 is an example of the second adsorber, the HF adsorption column 60 is an example of the third adsorber, and the HF adsorption column 61 is an example of the fourth adsorber.

Further, the open/close valves V1-V4, V15-V18 are an example of the connector, the states of the open/close valves V1-V4, V15-V18 in the first operating state shown in FIG. 2 are an example of the first state, the states of the open/close valves V1-V4, V15-V18 in the second operating state shown in FIG. 3 are an example of the second state, the heating furnace 80 is an example of the first heater, the heating furnace 81 is an example of the second heater, the control device 90 is an example of the controller, the pipe 49 is an example of the first circulation path, the pipes 29, 30 are an example of the second circulation path, fluorine gas is an example of the fourth gas, the buffer tank 52 and the pipe 47 are an example of the first gas supplier, the inert gas such as nitrogen, argon, or helium is an example of the fifth gas, the inert gas tank 53 and the pipe 27 are an example of the second gas supplier, the buffer tank 52 is an example of the storage, and the pipe 47 is an example of the gas supply path.

As the elements recited in the claims, a variety of other elements having the configuration or function recited in the claims may be used as well.

[Industrial Applicability]

The present invention is applicable to the supply of gases to a variety of processing equipment.

The invention claimed is:

1. A gas generation device that generates a first gas and a second gas by electrolysis, comprising:

an electrolyzer divided into a first chamber and a second chamber and containing therein an electrolytic bath including a compound to be electrolyzed;

a first discharge path through which the first gas generated in said first chamber is discharged;

a second discharge path through which the second gas generated in said second chamber is discharged;

first and second adsorbers that each include an adsorbent for adsorbing a third gas mixed in the first gas;

third and fourth adsorbers that each include an adsorbent for adsorbing the third gas mixed in the second gas;

a connector configured to be switchable between a first state and a second state, the first state being the state where said first and third adsorbers are connected to said first and second discharge paths, respectively, and said second and fourth adsorbers are disconnected from said first and second discharge paths, respectively, the second state being the state where said second and fourth adsorbers are connected to said first and second discharge paths, respectively, and said first and third adsorbers are disconnected from said first and second discharge paths, respectively;

a first heater that heats the adsorbents in said first and third adsorbers;

a second heater that heats the adsorbents in said second and fourth adsorbers; and a controller that controls said connector, said first heater, and said second heater, wherein said controller switches said connector between said first state and said second state, and when said connector is in said first state, said controller controls said first and second heaters such that the third gas is adsorbed by the adsorbents in said first and third adsorbers and the third gas is desorbed from the adsorbents in said second and fourth adsorbers, and when said connector is in said second state, said controller controls said first and second heaters such that the third gas is adsorbed by the adsorbents in said second and fourth adsorbers and the third gas is desorbed from the adsorbents in said first and third adsorbers, the gas generation device further comprising:

a first circulation path through which the third gas desorbed from the adsorbent in said second adsorber is guided to said first chamber when said connector is in said first state, and through which the third gas desorbed from the adsorbent in said first adsorber is guided to said first chamber when said connector is in said second state; and a second circulation path through which the third gas desorbed from the adsorbent in said fourth adsorber is guided to said second chamber when said connector is in said first state, and through which the third gas desorbed from the adsorbent in said third adsorber is guided to said second chamber when said connector is in said second state.

2. The gas generation device according to claim 1, further comprising:

a first gas supplier that supplies a fourth gas to said second adsorber when said connector is in said first state, and that supplies said fourth gas to said first adsorber when said connector is in said second state; and a second gas supplier that supplies a fifth gas to said fourth adsorber when said connector is in said first state, and that supplies said fifth gas to said third adsorber when said connector is in said second state.

3. The gas generation device according to claim 2, wherein said first gas supplier includes a storage that stores part of the first gas discharged through said first discharge path, and a gas supply path through which the first gas stored in said storage is guided as said fourth gas to said second adsorber when said connector is in said first state, and through which the first gas stored in said storage is guided as said fourth gas to said first adsorber when said connector is in said second state.

4. The gas generation device according to claim 3, wherein of the first gas discharged through said first discharge path, an excess over a required amount is stored in said storage.

5. The gas generation device according to claim 1, wherein said first gas is fluorine gas, said second gas is hydrogen, said third gas and said compound are hydrogen fluoride, said adsorbents are sodium fluoride, said first chamber is an anode chamber, and said second chamber is a cathode chamber.

* * * * *